US005791702A

United States Patent [19]

Liroff

[11] Patent Number: 5,791,702

[45] Date of Patent: Aug. 11, 1998

[54] TAMPER EVIDENT, CARGO CONTAINER DOOR LOCK

[76] Inventor: Jeff Liroff, 3140 Paddock Rd., Fort Lauderdale, Fla. 33331

[21] Appl. No.: 675,038

[22] Filed: Jul. 3, 1996

[51] Int. Cl.[6] ..... B65D 55/00

[52] U.S. Cl. ..... 292/307 R; 292/327; 70/202

[58] Field of Search ..... 292/307 R, 307 B, 292/317, 320, 327, DIG. 32, 318; 70/202, 203, 211, 212, 54, 55, 56

[56] References Cited

U.S. PATENT DOCUMENTS

| | | | |
|---|---|---|---|
| 3,862,775 | 1/1975 | Gudmundsen | 292/327 |
| 4,010,788 | 3/1977 | Van Gompel | 292/327 X |
| 4,152,910 | 5/1979 | Swisher | 292/307 B |
| 4,389,862 | 6/1983 | Hastings | 292/DIG. 32 X |
| 4,626,009 | 12/1986 | Burnett et al. | 292/327 |
| 4,630,456 | 12/1986 | Nielsen, Jr. | 292/307 B X |
| 5,118,149 | 6/1992 | Emmons | 292/327 |
| 5,337,503 | 8/1994 | Goby | 292/318 X |
| 5,553,904 | 9/1996 | Lorenzo | 292/307 B X |

*Primary Examiner*—Rodney M. Lindsey
*Attorney, Agent, or Firm*—Malloy & Malloy, P.A.

[57] ABSTRACT

A tamper evident, cargo container door lock structured to be used on a cargo container of the type having a pair of doors secured in a closed orientation by a closure assembly of the type including a lock rod and an actuation handle connected to the lock rod to facilitate pivotal movement of the lock rod and permit slided movement thereof to release the door from the closed orientation, the door lock including a primary shroud assembly formed of a substantially strong, cut resistant metal and structured to cover and shield from external access a connection joint between the actuation handle and the lock rod of the closure assembly, thereby preventing access to the connection joint without cutting or removing the primary shroud assembly. Further, the door lock includes a pivot brace which securely engages the primary shroud assembly and prevent pivotal movement thereof about an axis of the lock rod, thereby preventing pivotal movement of the actuation handle and the connection joint of the closure assembly which are encased by the primary shroud assembly. Both the pivot brace and the primary shroud assembly are covered by a tamper evident coating which is substantially difficult to un-noticeably repair upon the primary shroud assembly or the pivot brace, and accordingly the tamper evident coating, being cut, thereby providing a clear, positive indication of tampering with the door lock.

16 Claims, 5 Drawing Sheets

TAMPER EVIDENT, CARGO CONTAINER DOOR LOCK

BACKGROUND OF THE INVENTION

1. Field of the Invention

The present invention relates to a tamper evident, cargo container door lock which is structured to maintain a cargo container's doors securely locked in a closed orientation and prevent opening thereof without destructively removing the door lock in a manner which clearly indicates tampering has occurred, even if the lock is replaced, thereby substantially protecting the contents of the cargo container, while also substantially identifying the leg of a transport route at which tampering has occurred.

2. Description of the Related Art

Large, cargo containers, such as those that e detachable or are formed as part of trailers are the most commonly used means of transporting large volumes of many varying cargos from location to location around the world. A primary advantage to their use is that the large containers can store large quantities of goods and can be effectively transported on boats, trains, and/or trucks in order to expeditiously arrive at their eventual destination. The detachability and adaptability of containers is of particular importance because the containers will often change hands from one carrier to another carrier, such as from a train to a truck or from a trucking company to a steamship line, during the various legs of a transport route.

Naturally, due to the great volume and often valuable nature of the cargos being transported in the large containers, security is an important consideration when dealing with cargo transportation. Unfortunately, however, one of the most prevalent security concerns, in addition to the third party hijackers or thieves who do not generally care if they leave signs of a break in, involves internal not obviously detectable theft. For example, it is sometimes an all too common occurrence that during transit, an individual placed in custody of the container, such as a truck driver in charge of transporting the cargo from point to point, is behind a robbery. Such an individual is naturally very familiar with the nature of the cargo on board, and can easily arrange for a safe rendezvous for the removal of all or part of the cargo contained within the large container. Unlikely as it may seem, in these instances, it is often the security measures and/or locks which are normally employed that serve as the biggest ally to the thieves.

A single-use seal commonly secures the door handle/latch in a door closing orientation, and yet thieves have still found ways to unlatch the doors without actually breaking the seal. Specifically, the joint between the actuation handle and the lock rod on most conventional containers generally incorporates a single bolt securing both elements with one another. As a result, a thief can merely cut or drill out and remove that bolt to permit the independent turning of the lock rod while the actuation handle remains in place, thereby opening the container without having to move the actuation handle or break the seal. Once the cargo has been removed and the door is re-closed, a replacement bolt is merely inserted to connect the actuation handle with the lock rod, and can be painted over if necessary to preserve the original appearance. As a result, the identifying seal has never been removed and no evidence of tampering is available as the cargo changes hands from one carrier to another. Accordingly, when the specific carrier involved in the theft arrives at a next leg of the transport, the container looks normal and intact, and the responsibility is passed on to the next transport carrier. Naturally, when the theft is ultimately discovered blame passes from carrier to carrier with no concrete resolution as to the true thieves or the actual stage of transport during which the theft occurred. Moreover, as no positive blame can be put on any particular carrier, it is often the owner of the cargo who must take the loss and must fight their insurance company for some recovery.

Despite the numerous techniques thieves have found to defeat existing systems, and because of the high volume of cargo being transported on a daily basis, and the cost of more extensive security measures, most carriers still utilize the above-described securing methods to seal the cargo doors. Such carriers accept a certain percentage of losses to theft as an expense of doing business given the lack of a viable alternative. Accordingly, it would be highly beneficial to provide a cargo container door lock which can defeat or at least significantly hinder the "inside job" theft in a cost effective and easy to implement fashion. Such an improved container door lock should be structured so as to maintain the doors properly closed and secured, be substantially difficult to remove so as to permit opening the door by requiring more than one cut of thick metal segments, and provide substantially clear and noticeable evidence of tampering, thereby allowing the identification of a theft by a transport company when they take on the cargo. Further, such a container door lock should not permit independent rotation of the lock rod separate from the actuation handle, and should be practical for single shipment, one time use.

For these reasons, some shippers have turned to utilizing single use locking brackets which employ single use seals which bear a particular, recorded serial number thereon if added security is desired. Accordingly, when the cargo container changes hands from one carrier to another the lock is inspected and the numerals on the seal(s) are recorded to ensure that they match the shipping records. Still, however, while such techniques are more effective than the security measures which had previously been available, clever thieves have quickly found ways around those procedures as well.

Specifically, because a thief associated with a transport attendant may have extended time and can choose a location for a theft to occur, techniques not usually available to the common thief can be employed. In particular, a thief, usually equipped with a blowtorch, will first cut the bracket between the two doors at a central point thereof, thereby permitting the free movement of the doors relative to one another. Such cutting of the bracket does not remove or damage the seal which keeps the bracket in place, and accordingly, when the theft is completed, the thieves can merely weld the two sections of the bracket back together. Further, a rapid coat of silver paint is usually sufficient to match the normal zinc coated finish of the bracket and completely mask that the bracket has been removed. Alternatively, if as in most instances the bracket is merely locked or welded in place, a new bracket can be replaced on the closed doors.

SUMMARY OF THE INVENTION

The present invention relates to a tamper evident cargo container door lock. The door lock is structured for use on a cargo container of the usual type which includes at least one door secured in a closed orientation by a closure assembly. The closure assembly is generally of the type that includes at least one lock rod to hold each door in a closed orientation, and an actuation handle that is pivoted away from the door in order to rotate the lock rod and permit slided movement thereof into a door releasing orientation.

Specifically, the tamper evident, cargo container door lock of the present invention includes a primary shroud assembly. The primary shroud assembly, which is formed of a substantially strong, cut resistant material, is structured to substantially cover and shield a connection joint between the actuation handle and the lock rod of the closure assembly on the cargo container door. As such, the primary shroud assembly substantially prevents external access to the connection joint unless the primary shroud assembly is cut or otherwise physically removed from its covering orientation over the connection joint. Moreover, the primary shroud assembly is structured to be secured about the actuation handle in such a manner as to restrict vertical movement thereof relative to the lock rod, thereby preventing the door lock of the present invention from being slid up a length of the lock rod.

Additionally, the door lock of the present invention includes a pivot brace. The pivot brace is structured to securely engage the primary shroud assembly and prevent pivotal movement thereof about an axis of the lock rod. Accordingly, as the primary shroud assembly is secured about the actuation handle and connection joint, by preventing pivotal movement of the primary shroud assembly, pivotal movement of the actuation handle, the connection joint and the lock rod of the cargo container closure assembly is also prevented.

In order to clearly and readily identify if the primary shroud assembly and/or the pivot brace have been tampered with or otherwise cut, the door lock of the present invention further includes tamper evident coating means. Specifically, the tamper evident coating is structured to cover the primary shroud assembly and the pivot brace, and be substantially difficult to un-noticeably repair if cut through, such as by a torch. As a result, the tamper evident coating provides a positive indication of tampering which can be easily identified when a cargo container changes hands.

Lastly, fastening means are employed to secure the primary shroud and the pivot brace with one another and in place over the connection joint between the actuation handle and the lock rod. As a result, the primary shroud and the pivot brace work together to keep the door lock of the present invention operatively disposed on the cargo container door.

It is an object of the present invention to provide a cargo container door lock which is substantially difficult to break open in order to access an interior of a cargo container.

A further object of the present invention is to provide a cargo container door lock which once opened cannot be readily and unnoticeably repaired in order to cover up unauthorized entry into the cargo container.

Another primary object of the present invention is to provide a cargo container door lock which prevents movement of the cargo containers closure assembly lock rod independent from its actuation handle.

Another object of the present invention is to provide a cargo container door lock which is substantially cost-effective to implement on a cargo container on a single use basis.

A further object of the present invention is to provide a tamper evident cargo container door lock which will readily identify that the cargo container's doors have been opened, thereby identifying a stage of transport at which the cargo container was opened.

BRIEF DESCRIPTION OF THE DRAWINGS

For a fuller understanding of the nature of the present invention, reference should be had to the following detailed description taken in connection with the accompanying drawings in which:

FIG. 1-A is an isolated, closeup view of the closure assembly of the cargo container illustrated in FIG. 1;

FIG. 2-A is an isolated, closeup view of the embodiment of FIG. 2;

FIG. 3-A is an isolated, closeup view of the embodiment of FIG. 3;

FIG. 4-A is an isolated view of a cargo seal utilized with the present invention;

Like reference numerals refer to like parts throughout the several views of the drawings.

DETAILED DESCRIPTION OF THE PREFERRED EMBODIMENT

Figure 1:
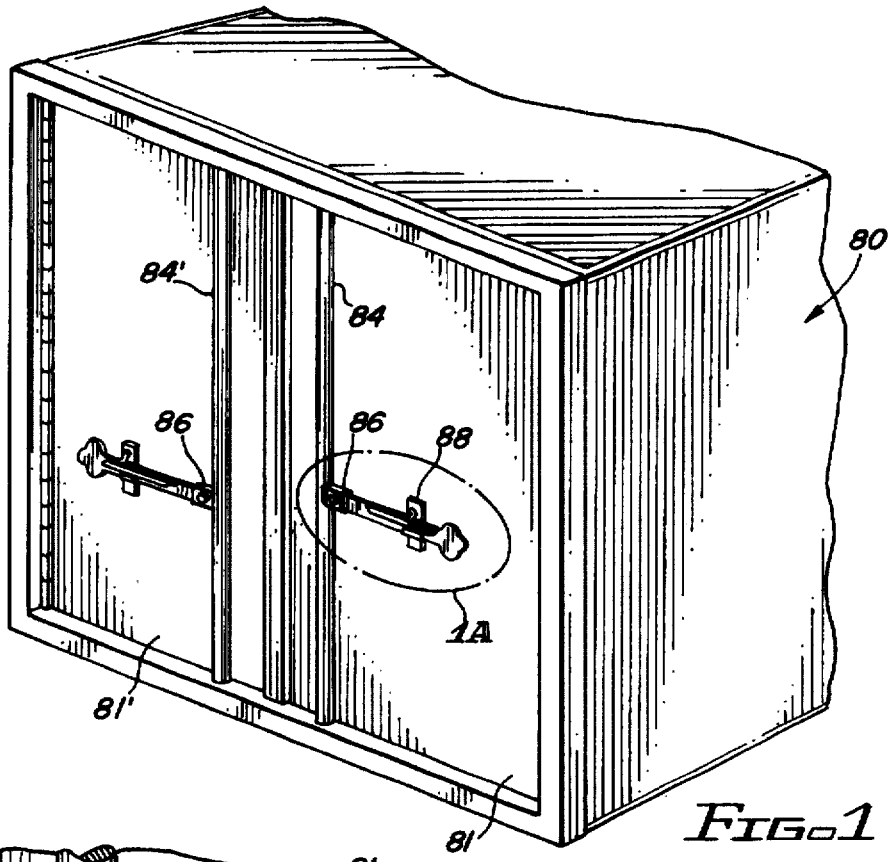
FIG. 1 is a perspective view of a rear door of a cargo container.
Figure 1A:
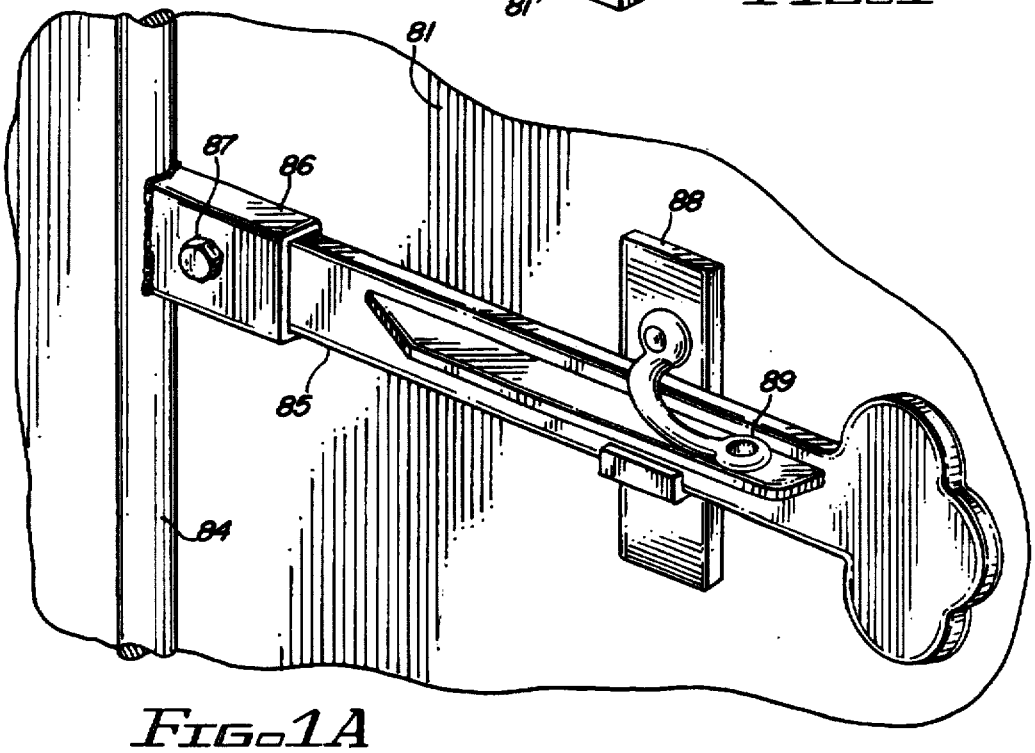
Figure 2:
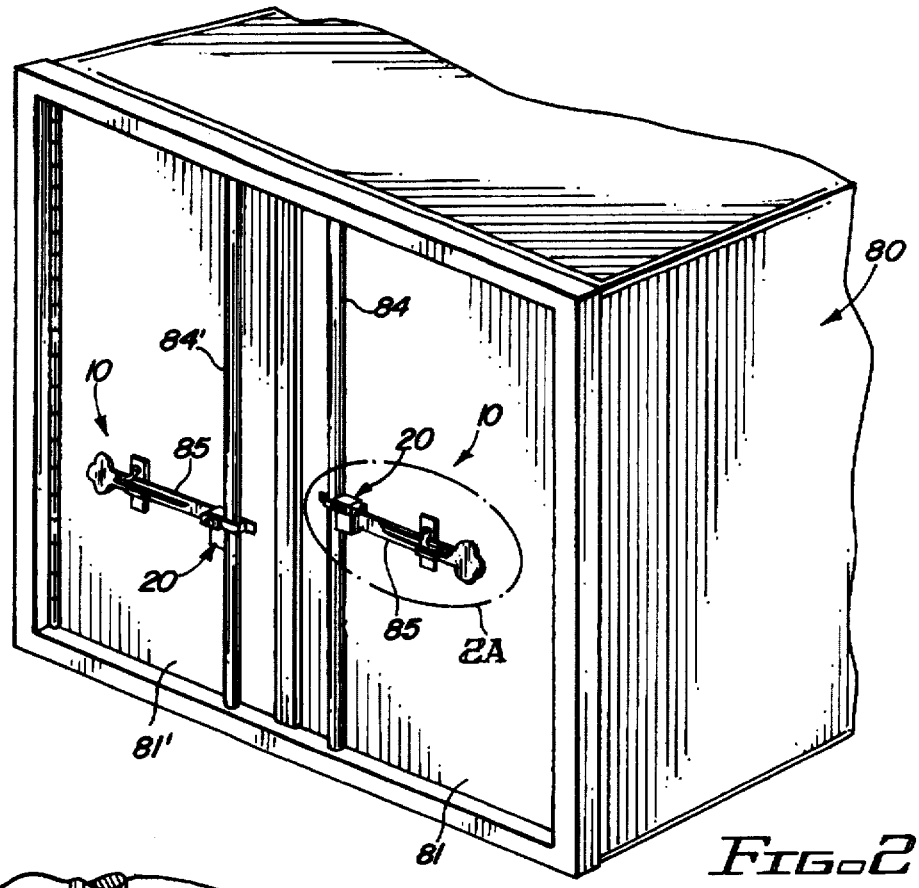
FIG. 2 is a perspective view of the first embodiment of the present invention disposed on a cargo container.
Figure 2A:
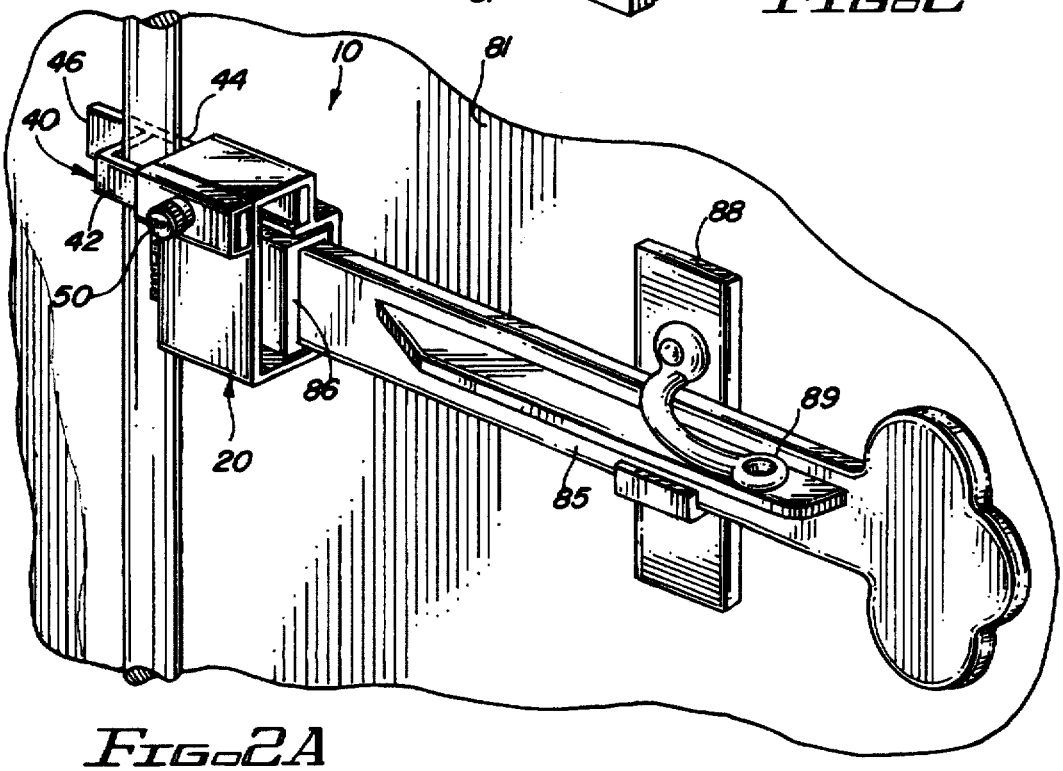

The present invention is directed towards a tamper evident, cargo container door lock, generally indicated as 10. Specifically, the cargo container door lock 10 is structured for use on a cargo container 80 of the type that typically includes a pair of doors 81 and 81' secured in a closed orientation by a closure assembly. The cargo container 80 itself can either be of a detachable kind or can be included as part of a trailer.

Looking first to the conventional container closure assembly, generally, it will be of the type that includes at least one lock rod 84 and 84' on each door 81 and 81' to maintain the doors secured in a closed orientation. Moreover, connected with each of the lock rods 84 and 84' is an actuation handle 85 which permits appropriate maneuvering of the lock rod 84 to latch and un-latch the door 81. In particular, a first one of the doors 81 is generally the main door which holds the other, second door 81' closed until it is moved. The actuation handle 85 of that main door 81 generally rests within a bracket 88 where it can be locked or sealed in place. Typically, the bracket 88, which holds the actuation handle 85 in its door closing orientation so that the lock rod 84 maintains the door 81 latched, includes a lock flange 89 which extends down onto the actuation handle 85. The lock flange 89 is structured and disposed so that a seal or padlock may be secured therethrough to secure the actuation handle 85 in the bracket 88 and in its generally flat engagement along the door 81 which maintains the lock rod 84 in a door latching orientation.

The actuation handle 85 itself is generally connected to the lock rod 84 at a connection joint 86 disposed therebetween. In particular, the connection joint 86 is welded and/or otherwise integrally secured with the lock rod 84, and generally includes a large bolt 87 extending therethrough and into the actuation handle 85. Accordingly, with the actuation handle 85 secured to the lock rod 84 at the connection joint 86, upon pulled movement of the actuation handle 85 away from the door 81 and into a generally perpendicular orientation, the lock rod 84 will also rotate and can be moved to unlatch the door 81 from its closed orientation.

Turning now to the tamper evident cargo container door lock 10 of the present invention, it includes a primary shroud assembly 20. The primary shroud assembly 20 is formed of a substantially strong, cut resistant metal, such as steel, and will be configured such that it must be cut by a blowtorch, or a similar high power cutting device, to be removed. Further, the primary shroud assembly 20 is structured to substantially cover and shield from external access the connection joint 86 between the actuation handle 85 and the lock rod 84 of the cargo door closure assembly. As such, the primary shroud assembly 20 will substantially prevent access to the connection joint unless it is removed.

In the preferred embodiment, the primary shroud assembly 20 includes a front face 21, a rear face 22 and a pair of opposite side faces 23 and 24, which define an open interior 25 through which the actuation handle 85 extends. Further, although the primary shroud assembly 20 need not be completely enclosed, in the preferred embodiment, it will include a substantially tubular configuration to wrap completely about the actuation handle 85 and thereby more effectively restrict removal of the primary shroud assembly 20 from the actuation handle 85 unless it is cut or slid off of the free end of the actuation handle 85, which cannot occur without freeing the actuation handle 85 from the lock flange 89 and can only be accomplished by breaking or removing the container seal or padlock. Moreover, by substantially enclosing and encasing the actuation handle 85 and connection joint 86, vertical movement of the primary shroud assembly 20, and therefore the door lock 10, relative to the lock rod 84 and actuation handle 85 is restricted.

In addition to substantially covering and concealing the connection joint 86, the primary shroud assembly 20, as illustrated in the figures, is structured with a substantially narrow open interior 25. As such, minimal spacing exists between an interior wall surface of the primary shroud assembly 20 and the connection joint 86, and access to the connection joint 86 through an open side of the primary shroud assembly 20, such as by bolt cutters, a wrench, or a torch is substantially restricted. Accordingly, the connection joint 86 cannot be detached from the actuation handle 85, so as to permit independent movement of a lock rod 84 relative to the actuation handle 85, without moving or removing the primary shroud assembly 20.

The tamper evident cargo container door lock 10 of the present invention further includes a pivot brace 40. The pivot brace 40 is structured to engage the primary shroud assembly 20, and be secured thereto, in order to prevent pivotal movement of the primary shroud assembly 20 about an access of the lock rod 84. As such, given that the primary shroud assembly 20 encases the actuation handle 85, the actuation handle 85 cannot be pivoted away from the container door 81 into a lock rod unlatching orientation. Moreover, even if the actuation handle 85 were somehow released or detached from the connection joint 86, as the primary shroud assembly 20 extends over and encases the connection joint 86, which is welded or otherwise integrally formed with the lock rod 84, the secure engagement of the primary shroud assembly 20 with the pivot brace 40 functions to resist pivotal rotation of the lock rod 84 itself into a releasable orientation.

Figure 4:
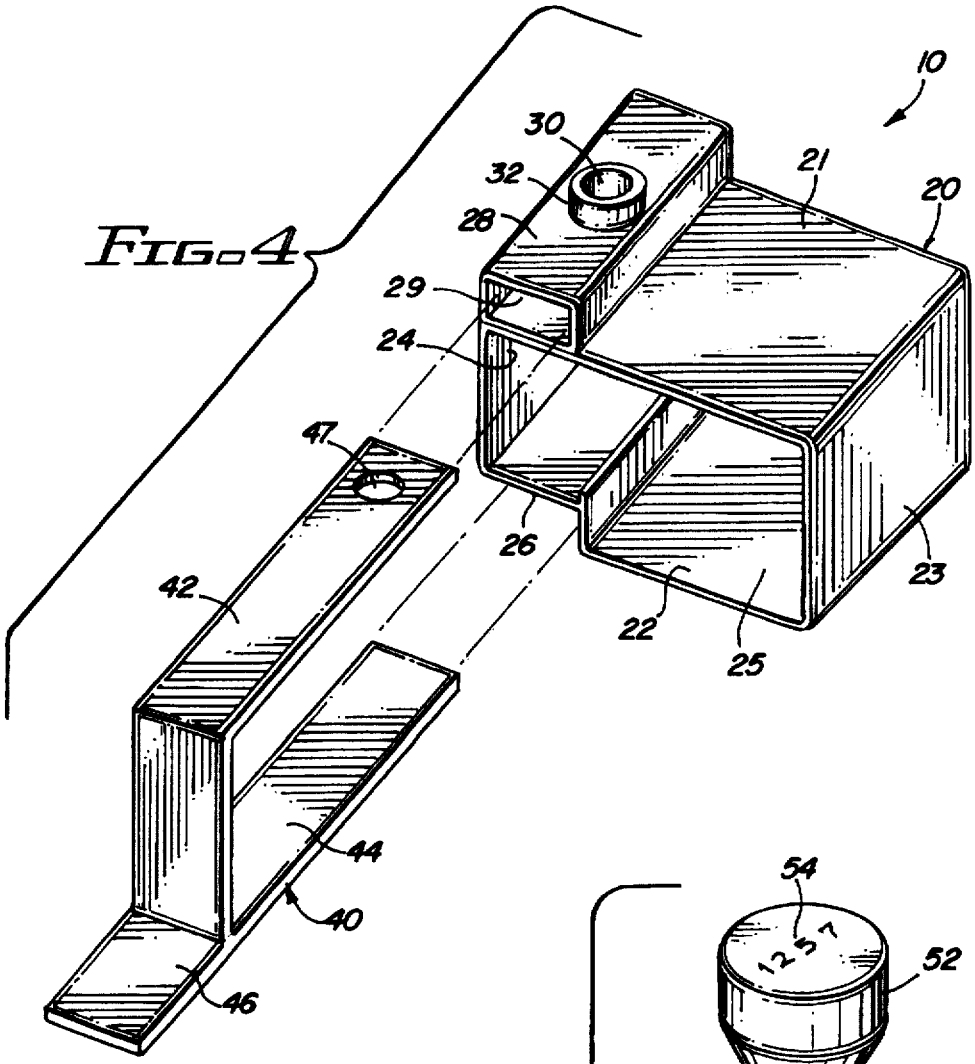
FIG. 4 is a perspective, exploded view of the preferred embodiment of the present invention.
Figure 4A:
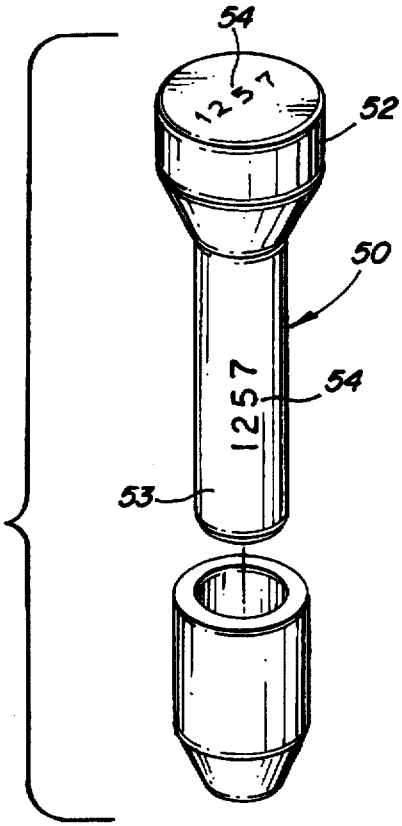
Figure 5:
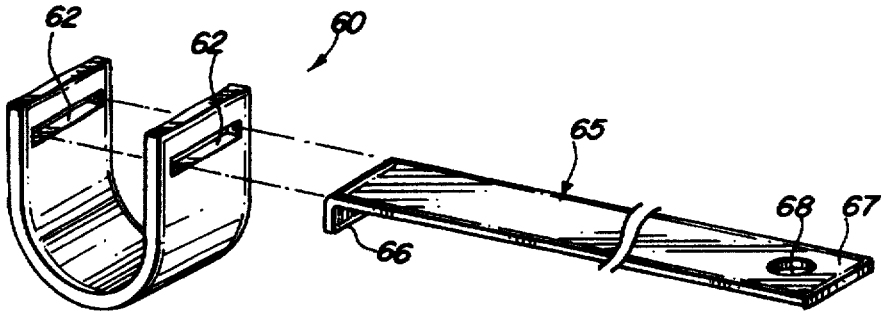
FIG. 5 is a perspective, exploded view of a cross brace and C-shaped bracket incorporated with the embodiment of FIG. 3.

In the preferred embodiments, the pivot brace 40 is structured to extend or wrap about the lock rod 84 and into secure engagement with the primary shroud assembly 20. As such, once secured with one another the primary shroud assembly 20 cannot be slid along the length of the actuation handle 85 to expose the connection joint 86, and the pivot brace 40 cannot slide vertically. In this regard, in the embodiment of FIG. 4, the pivot brace 40 includes a generally C-shaped clasping region having upper and lower elongate engagement segments 42 and 44 which extend about the lock rod 84 and towards the primary shroud assembly 20. At least one, and preferably the upper engagement segment 42 is fixedly secured to the primary shroud assembly 20, thereby securing the primary shroud assembly 20 with the pivot brace 40. In the embodiment of FIG. 4, the primary shroud assembly 20 includes a fastener channel 29 defined by an upper region 28 of the primary shroud assembly 20. This fastener channel 29 is structured to receive the upper engagement segment 42 of the pivot brace 40 in slided relation therein. Moreover, the fastener channel 29 will preferably be sized so as substantially correspond the engagement segment 42 be introduced therein and permit minimal spacing for external access. Further, although not absolutely necessary, in the embodiment illustrated, the lower engagement segment 44 is structured to extend beneath the primary shroud assembly 20 within a channel 26 disposed in parallel relation with the fastener channel 29. Accordingly, a more secure, clasped engagement between the pivot brace 40 and the primary shroud assembly 20 can be achieved.

Disposed in overlying relation with one another within at least the upper engagement segment 42 of the pivot brace 40 and the upper region 28 of the primary shroud assembly 20 that defines the fastener channel 29 are cargo seal receiving apertures 30 and 47. Specifically, the cargo seal receiving apertures 30 and 47 are structured and disposed to receive a single use cargo seal 50 therethrough in order to achieve secure, fastened interconnection between the pivot brace 40 and the primary shroud assembly 20. In this regard, it should be noted that the primary shroud assembly 20 need not include a specifically defined fastener channel 29, but rather the engagement segment 42 of the pivot brace 40' may merely overly the front face 21 of the primary shroud assembly 20 for secure engagement therebetween by the single use cargo seal 50.

Figure 6:
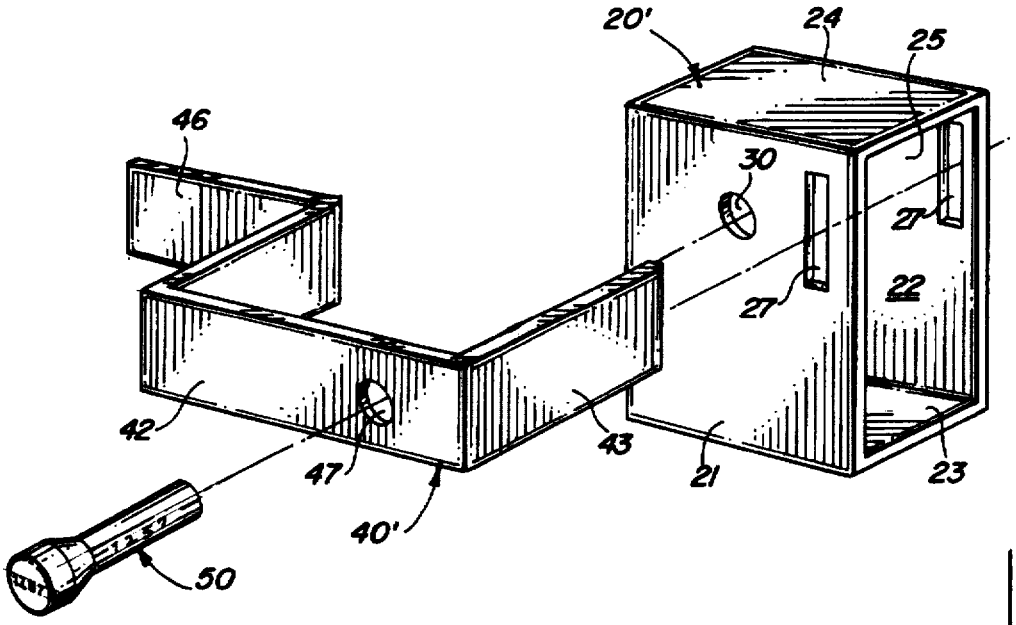
FIG. 6 is an exploded perspective view of yet another embodiment of the present invention.

Turning to the alternative embodiment of FIG. 6, the pivot brace 40' may also include a downwardly dependent segment 43. That downwardly depending segment 43 is structured to pass through a pair of correspondingly positioned apertures 27 defined in the primary shroud assembly 20'. Those apertures 27 receive the downwardly depending segment 43 and further act to prevent detachment and/or slided movement of the primary shroud assembly 20' relative to the pivot brace 40'. In this embodiment, the engagement member 42 merely overlies the front face 21 of the primary shroud assembly 20' for secure engagement utilizing the single use cargo seal 50. It should also be noted, that in this embodiment the downwardly depending segment 43 also functions to at least partially shield the open interior 25 of the primary shroud assembly 20', further restricting access to the connection joint 86 and the cargo seal 50.

From the previous description it can be seen that the primary shroud assembly 20 and the pivot brace 40 act together to maintain secure, protective interconnection over the connection joint 86. In particular, the encased engagement of the primary shroud assembly 20 about the actuation handle 85 and connection joint 86 prevents relative movement between the primary shroud assembly 20 or the pivot brace 40. of course, however, a primary function of the pivot brace 40 is to resist pivotal movement of the primary shroud assembly 20 relative to an axis of the lock rod 84, and therefore pivotal movement of the actuation handle 85 and connection joint 86 into a door unlatching orientation. As specifically seen in the Figures, in order to prevent pivotal movement, the pivot brace 40 includes an outwardly depending flange 46. The outwardly depending flange 46 is structured to extend in a generally parallel, closely spaced relation with a surface of the door 81 of the cargo container 80. Accordingly, the flange 46 functions to prevent pivotal movement due to the fact that it will immediately abut the door 81 upon pivotal movement of the actuation handle 85 or the connection joint 86 which are encased by the primary shroud assembly 20.

Looking more specifically to the single use cargo seal 50, it is structured to be introduced into a precisely sized opening in order to achieve permanent closure until it is broken. Conventionally, cargo seals have been utilized to extend through the actuation handle 85 and lock flange 89 secured to the bracket 88 in order to hold the actuation handle in place and provide some indication of tampering. As previously recited, however, such sealing has been easily circumvented by detachment of the actuation handle 85 at the connection joint 86. Nevertheless, it is beneficial to incorporate a single use cargo seal 50 with the door lock 10 of the present invention. In particular, the present invention preferably includes a cargo seal 50 structured to extend through the primary shroud assembly 20 and the pivot brace 40, thereby providing secure interconnection therebetween. Further, the cargo seal 50, preferably includes a specific serial number 54 etched or otherwise permanently formed therein. The serial number 54 is preferably disposed in a conspicuous location such as on a head 52 of the seal 50 or on an elongate body 53 of the seal 50. However, the serial number 54 is unique to the particular seal and is structured to be recorded, thereby ensuring that the seal which was originally placed on the container 80, is in fact the same seal.

From the previous description, it can be seen that the integral, secured interconnection by all of the elements of the door lock 10 in a tight, closely spaced area makes it substantially difficult to cut any single element at a location which will make exposure of the connection joint 86 and/or general opening of the cargo door 81 possible. In particular, the door lock is structured such that it is substantially difficult to cut the cargo seal 50 without destroying the door lock 10. Still, however, so as to further prevent access to the cargo seal 50, disposed about an outer most one of the cargo seal receiving apertures 30 or 47 is a shielding hub 32. Specifically, the shielding hub 32 is structured to extend upwardly so as to receive a head 52 of the cargo seal 50 therein and prevent access to the head 52 of the cargo seal 50 for potential pulled removal thereof.

Figure 3:
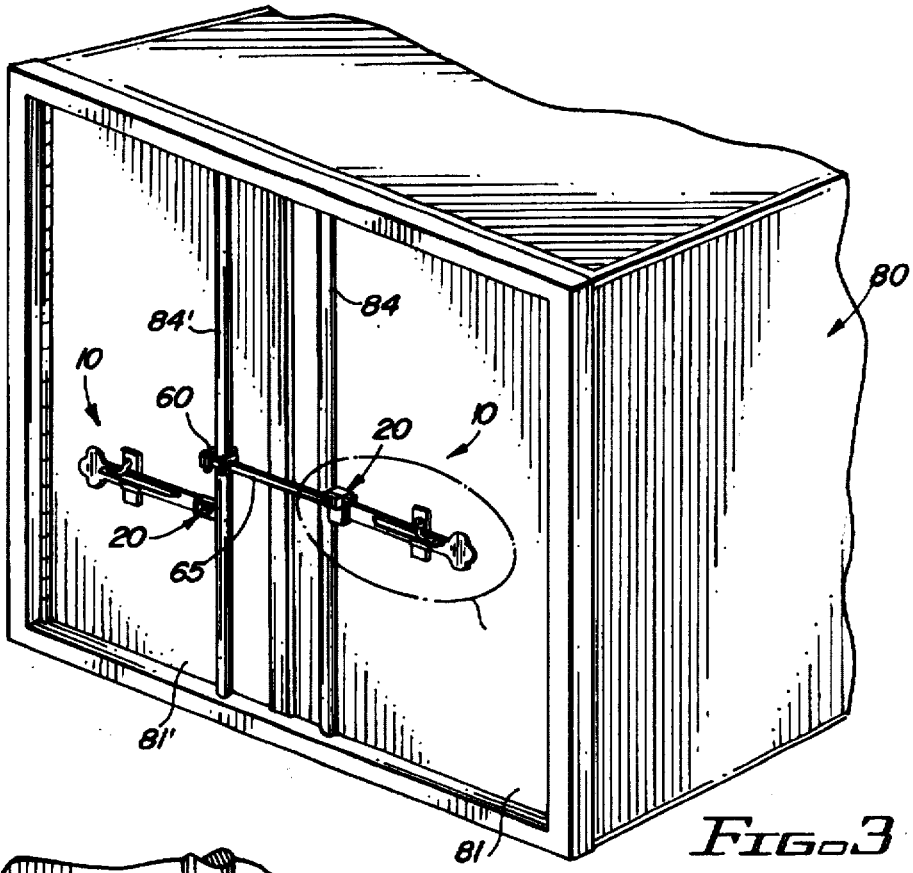
FIG. 3 is a perspective view of an alternative embodiment of the present invention on a cargo container.
Figure 3A:
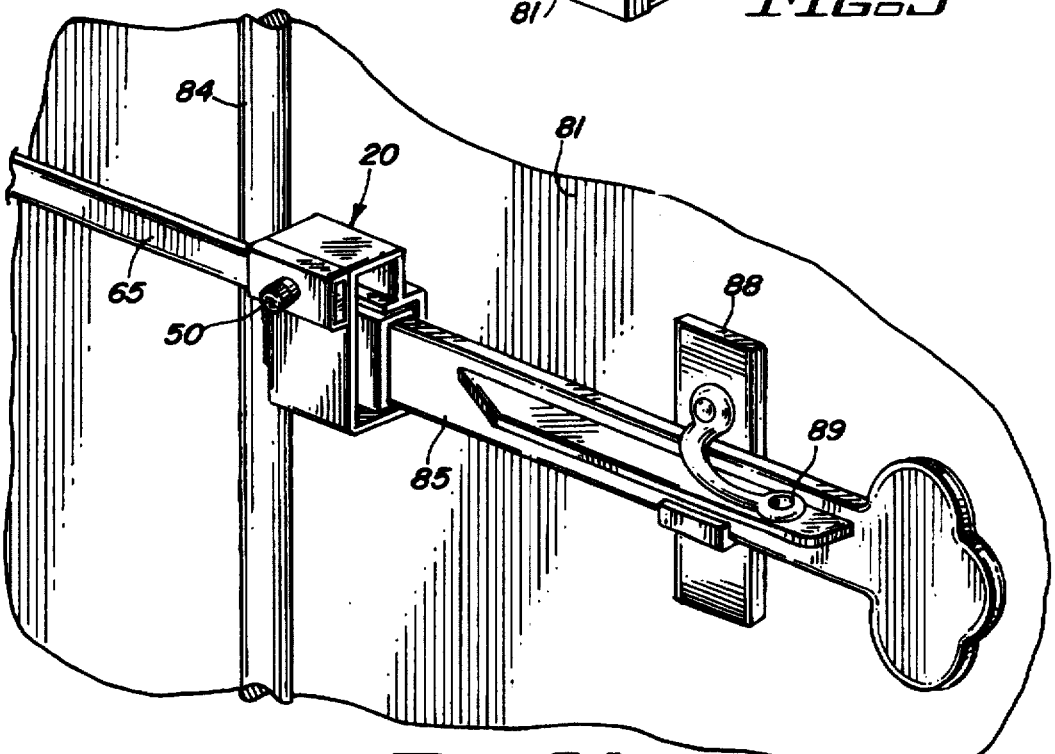

Turning to FIGS. 3, 3-A and 5, in a further embodiment of the present invention, the tamper evident cargo container door lock 10 also includes an elongate cross brace 65. Specifically, the cross brace 65 has a first end 67 and a second end 66, with the first end 67 being structured to securely engage the primary shroud assembly 20. The first end 67 of the cross brace 61 preferably includes a generally flat, configuration, and also includes a cargo seal receiving aperture 68 defined therein. The cargo seal receiving aperture 68 at the first end 67 of the cross brace 65 is structured to be positioned in overlying relation with the cargo seal receiving aperture 47 on the pivot brace 40 and the cargo seal receiving aperture 30 on the primary shroud assembly 20. As such, the single use cargo seal 50 can extend simultaneously through all three apertures 30, 47, and 68 to secure the various elements with one another. Moreover, in the embodiment of FIG. 4 wherein a fastener channel 29 is provided, it is preferred that the fastener channel 25 be formed slightly larger than a thickness of the engagement member 42 of the pivot brace 40 so as to be structured to receive both the engagement member 42 of the pivot brace 40 and the first end 67 of the cross brace 65 into slided relation therein, with minimal room for movement or exterior access remaining.

The second end 66 of the cross brace 65 is preferably structured to extend from the lock rod 84 on the first door 81 to the lock rod 84' on the second door 81' for secure engagement therewith. In particular, in the preferred embodiment a generally U-shaped bracket 60 is structured to extend about the lock rod 84' on the second door 81' and receive the cross brace 65 therethrough. In this embodiment, the U-shaped bracket 60 preferably includes a pair of apertures 62 where through a first end 67 of the cross brace 65 may slide as it is extended across into engagement with the primary shroud assembly 20. In this regard, the second end 66 of the cross brace 65 has a generally downwardly depending, angled configuration. This downwardly depending configuration functions to prevent the cross brace 65 from being pulled completely through the U-shaped bracket 60 towards the first door 81. As such, during installation the U-shaped bracket 60 is positioned about the lock rod 84', and the first end 67 of the cross brace 65 is slid through the apertures 62 formed in the U-shaped bracket 60. Once passing through the U-shaped bracket 60, the cross brace 65 continues to be pushed towards the first door 81 until its first end 67 extends into an engaging orientation with the primary shroud assembly 20 and the pivot brace 40. At that point, the cargo seal 50 is extended through all three elements, namely the primary shroud assembly 20, the pivot brace 40 and the cross brace 65 to completely secure and seal the entire assembly. It is noted that the cross brace 65 by extending across both lock rods 84 and 84' prevents the outward opening of the doors 81 and 81' even if unlatched. This feature therefore provides yet another element which must be cut by a would-be thief in order to access the container.

Lastly, the tamper evident cargo container door lock 10 of the present invention includes tamper evident coating means. Specifically, the tamper evident coating is structured to completely cover and coat the primary shroud assembly 20, the pivot brace 40 and in the embodiment including the cross brace 65, the cross brace 65 as well, to provide structure to indicate if any element has been cut and subsequently welded or repaired. Specifically, the tamper evident coating is structured to provide each element with a substantially noticeable surface finish, which if cut through in order to remove the pivot brace 40 the cross brace 65 or the primary shroud assembly 20 will provide a positive, highly noticeable indication of tampering. In the preferred embodiment, the tamper evident coating includes a powder coated finish disposed on the primary shroud assembly 20, the pivot brace 40, and the cross brace 65. In particular, the powder coated finished is a specialized and difficult to duplicate surface coating that provides a rough, substantially randomized finish, which once cut through is very difficult to duplicate, especially in small portions at a remote location. Accordingly, if a thief enters the cargo container 80 by opening the rear doors 81 and 81' they must necessarily cut through all or part of the tamper evident cargo container door lock 10 of the present invention, that cut making the powder coated finish visibly damaged especially if the segments are rewelded together after cargo has been removed and the doors 81 and 81' are reclosed.

In another embodiment of the present invention the tamper evident coating includes chrome plating. Unlike a conventionally utilized zinc coating which can be easily painted over with silver paint to give a substantially un-tampered with appearance, chrome plating tends to burn and become dull in a general area about a point of the cut and reweld. Moreover, the chrome plated finish is also very difficult to reapply in small portions, especially at a point of a weld, and thereby provides a very noticeable indication of tampering if it is cut through.

As yet another embodiment, the tamper evident coating includes a vinyl coating disposed on the primary shroud 20, the pivot brace 40 and the cross brace 65. In this embodiment, each of the elements is subjected to a vinyl dip such that the vinyl coating will completely encase the assembly. As such, if the vinyl coating is cut through, the vinyl in that general area will melt, will become visibly damaged, and will be very difficult to repair at the point of cut. In this regard, it is of course noted that a variety of tamper evident coatings consistent with the present invention may also be utilized, the primary goal being to provide a clear and positive indication that the door lock 10 has been cut through upon a rapid, cursory inspection when the cargo container 80 changes hands from one carrier to another. Furthermore, because the single use seal extends through all of the elements and will be destroyed if removed, a thief cannot merely obtain a new, uncut door lock 10 and replace it on the container after the theft because the identifying serial numbers will not match up.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. To be used on a cargo container including at least one door secured in a closed orientation by a closure assembly including at least one lock rod and an actuation handle, the actuation handle being structured to be pivoted away from the door into a generally perpendicular orientation so as to rotate the lock rod and permit slided movement thereof to release the door from the closed orientation; a tamper evident, cargo container door lock comprising:

a primary shroud assembly, said primary shroud assembly being formed of a substantially strong, cut resistant metal, said primary shroud assembly being structured to substantially cover and shield from external access a connection joint between the actuation handle and the lock rod of the closure assembly, thereby substantially preventing access to the connection joint without cutting or removing said primary shroud assembly, and restricting vertical movement of said primary shroud assembly relative to the lock rod, a pivot brace structured to engage said primary shroud assembly and prevent pivotal movement thereof about an axis of the lock rod, said pivot brace including a generally elongate, outwardly depending flange structured to extend in generally parallel, closely spaced relation with a surface of the door of the cargo container so as to immediately abut the door upon pivotal movement thereof and thereby prevent pivotal movement of the lock rod, and fastening means structured to secure said primary shroud and said pivot brace in place over the connection joint.

2. A tamper evident, cargo container door lock as recited in claim 1 wherein said primary shroud assembly includes a generally tubular configuration structured to provide minimal spacing between an interior wall surface thereof and the connection joint, thereby substantially preventing access to the connection joint without removal of said primary shroud assembly.

3. A tamper evident, cargo container door lock as recited in claim 1 wherein said pivot brace is further structured to prevent lateral movement of said primary shroud assembly along the actuation handle, thereby preventing the connection joint between the actuation handle and the lock rod from becoming exposed.

4. A tamper evident, cargo container door lock as recited in claim 1 wherein said pivot brace is structured to extend about the lock rod and be fixedly secured with said primary shroud assembly.

5. A tamper evident, cargo container door lock as recited in claim 1 wherein said pivot brace includes a generally C-shaped clasping region structured to extend about the lock rod into secure, fixed engagement with said primary shroud assembly.

6. A tamper evident, cargo container door lock as recited in claim 5 wherein said primary shroud assembly includes a fastener channel into which at least one engagement segment of said C-shaped clasping region extends and at which said fastening means function to secure said primary shroud to said pivot brace in order to prevent removal of said pivot brace from its secure position about the lock rod and said primary shroud from its secure engagement about the actuation handle without separation of said pivot brace from said primary shroud.

7. A tamper evident, cargo container door lock as recited in claim 1 wherein said fastening means includes a single use cargo seal structured to secure said primary shroud with said pivot brace.

8. A tamper evident, cargo container door lock as recited in claim 7 wherein said cargo seal includes an identifying serial number imprinted thereon.

9. A tamper evident, cargo container door lock as recited in claim 8 wherein said primary shroud assembly includes a cargo seal receiving aperture into which said cargo seal is disposed, and a shielding hub disposed about said cargo seal receiving aperture so as to prevent tampering access to a head of said cargo seal.

10. A tamper evident, cargo container door lock as recited in claim 1 further including an elongate cross brace having a first end and a second end, said first end being structured to be fixedly secured with said primary shroud assembly disposed at the actuation handle of the lock rod on a first door of the cargo container, and said second end being structured to be securely engaged with a lock rod on a second door of the cargo container so as to prevent opening the doors.

11. A tamper evident, cargo container door lock as recited in claim 10 wherein said second end of said cross brace is structured to extend through a generally U-shaped bracket structured to extend about the lock rod on the second door of the cargo container.

12. A tamper evident, cargo container door lock as recited in claim 1 further including a tamper evident coating structured and disposed to cover said primary shroud assembly and said pivot brace, said tamper evident coating being substantially difficult to un-noticeably repair upon said primary shroud assembly or said pivot brace, and accordingly said tamper evident coating, being cut, thereby providing a clear, positive indication of tampering.

13. A tamper evident, cargo container door lock as recited in claim 12 wherein said tamper evident coating includes a powder coated finish disposed on said primary shroud assembly and said pivot brace, said powder coated finish being visibly damaged upon cutting of said primary shroud assembly or said pivot brace and including a substantially random, difficult to copy appearance which is substantially difficult to duplicate and un-noticeably repair.

14. A tamper evident, cargo container door lock as recited in claim 12 wherein said tamper evident coating includes a chrome plating disposed on said primary shroud assembly and said pivot brace, said chrome plating finish being visibly damaged upon cutting of said primary shroud assembly or said pivot brace and being substantially difficult to un-noticeably repair.

15. A tamper evident, cargo container door lock as recited in claim 12 wherein said tamper evident coating includes a vinyl coating disposed on said primary shroud assembly and said pivot brace, said vinyl coating being visibly damaged upon cutting of said primary shroud assembly or said pivot brace and being substantially difficult to un-noticeably repair.

16. To be used on a cargo container including at least one door secured in a closed orientation by a closure assembly including at least one lock rod and an actuation handle, the actuation handle being structured to be pivoted away from the door into a generally perpendicular orientation so as to rotate the lock rod and permit slided movement thereof to release the door from the closed orientation; a tamper evident, cargo container door lock comprising:

a primary shroud assembly, said primary shroud assembly being formed of a substantially strong, cut resistant metal, said primary shroud assembly being structured to substantially cover and shield from external access a connection joint between the actuation handle and the lock rod of the closure assembly, thereby substantially preventing access to the connection joint without cutting or removing said primary shroud assembly, and restricting vertical movement of said primary shroud assembly relative to the lock rod, a pivot brace structured to engage said primary shroud assembly and prevent pivotal movement thereof about an axis of the lock rod, said pivot brace including an outwardly depending flange structured to extend along a surface of the door of the cargo container in generally closely spaced relation therewith such that an interior surface of said flange is disposed in generally co-planar relation with a radially interior surface of the lock rod, to thereby substantially minimize pivotal movement of the lock rod, and fastening means structured to secure said primary shroud and said pivot brace in place over the connection joint.

* * * * *